US005142294A

United States Patent [19]

Smith

[11] Patent Number: 5,142,294

[45] Date of Patent: Aug. 25, 1992

[54] POWER ANTENNA DRIVE CABLE SEAL

[75] Inventor: Julian N. Smith, Farmington Hills, Mich.

[73] Assignee: General Motors Corporation, Detroit, Mich.

[21] Appl. No.: 745,676

[22] Filed: Aug. 16, 1991

[51] Int. Cl.[5] ..... H01Q 1/10

[52] U.S. Cl. ..... 343/903

[58] Field of Search ..... 343/901, 903

[56] References Cited

U.S. PATENT DOCUMENTS

| | | | |
|---|---|---|---|
| 4,323,902 | 4/1982 | Hussey et al. | 343/903 |
| 4,325,069 | 4/1982 | Hills | 343/903 |
| 4,353,075 | 10/1982 | Edwards | 343/903 |
| 4,527,168 | 7/1985 | Edwards | 343/901 |
| 4,956,647 | 9/1990 | Kimura | 343/901 |

FOREIGN PATENT DOCUMENTS

| | | | |
|---|---|---|---|
| 1081711 | 12/1954 | France | 343/903 |

*Primary Examiner*—Akm E. Ullah
*Assistant Examiner*—Robert E. Wise
*Attorney, Agent, or Firm*—Patrick M. Griffin

[57] ABSTRACT

A power antenna drive cable seal has a dynamic response to cable winding direction that allows the cable to slide through freely on the up stroke, when it is under compression, but which vigorously scrapes the cable on the down strike, when it is under tension. The seal is a resilient, bellows shaped unit with a flared throat that changes from a divergent, cable passing shape to a convergent, cable grabbing shape. the shape change is caused by the axial force of the cable changing direction.

2 Claims, 2 Drawing Sheets

POWER ANTENNA DRIVE CABLE SEAL

This invention relates to power antenna drive cable seals in general, and specifically to such a seal that changes shape depending on whether the cable is unwinding or rewinding.

BACKGROUND OF THE INVENTION

Telescoping power driven vehicle antennas are driven up and down by a flexible cable that unwinds from and rewinds onto a reel. The reel is contained within a housing located below the surface of the body panel from which the antenna emerges. In the up position, the cable will be exposed to environmental contaminants, such as water and dust, and it is desirable that these be scraped from the surface of the rewinding cable before it re-enters the housing. To do this adequately, any seal surrounding the cable must contact it with a fair amount of interference. This is not a problem as the cable is rewinding, because it is then under tension. When the cable is unwinding, however, the situation is different. Though stiffer than a string, the cable, like a string, can resist far less compression than tension. Since the cable is under compression as it unwinds, a tight scraping seal might exceed the compression threshold of the drive cable.

SUMMARY OF THE INVENTION

The invention provides a cable scraping seal that has a dynamic response to the direction of cable motion. As the cable is unwinding, it passes through freely, but as it is rewinding, it is more vigorously scraped.

The dynamic response is created by giving the seal a bi-stable feature. A body portion of the seal, which is a resilient rubber material, is generally conical. It responds to an axially downward force by collapsing from a stable convex configuration to a stable concave configuration. It rebounds in response to an upward force. The body portion merges into an open, flared throat that has an opening equal to, or slightly smaller than, the drive cable diameter. When the body portion is expanded, the throat is flared out into a divergent shape, and pulled into a convergent shape as the body portion collapses.

As a result, as the cable is unwinding under compression, it passes through the divergent throat freely. There is some friction, but the cable tends only to open the throat more as it passes through. When the cable rewinds, however, the friction pulls the body portion down and changes the throat shape. Now, the friction is greater, since the cable tends to bind as in is pulled through the convergent throat. However, the cable can easily resist the increased tension, and it is thoroughly scraped clean as it is rewound.

It is, therefore, a general object of the invention to provide a power antenna drive cable seal that does a good job of scraping away contaminants without overcompressing the cable as it unwinds.

It is another object of the invention to provide a cable seal that has a dynamic response, contacting the cable more strongly as it rewinds than as it unwinds.

It is another object of the invention to provide such a dynamic, direction sensitive response by giving the seal a bi-stable configuration in which the action of the cable winding and rewinding moves the seal between the two possible configurations.

It is yet another object of the invention to provide two different stable conjurations by giving the seal a collapsible and expandable body section that carries with it a throat that changes from a divergent, cable passing shape to a convergent, cable scraping shape.

DESCRIPTION OF THE PREFERRED EMBODIMENT

These and other objects and features of the invention will appear from the following written description, and from the drawings, in which.

Figure 1:
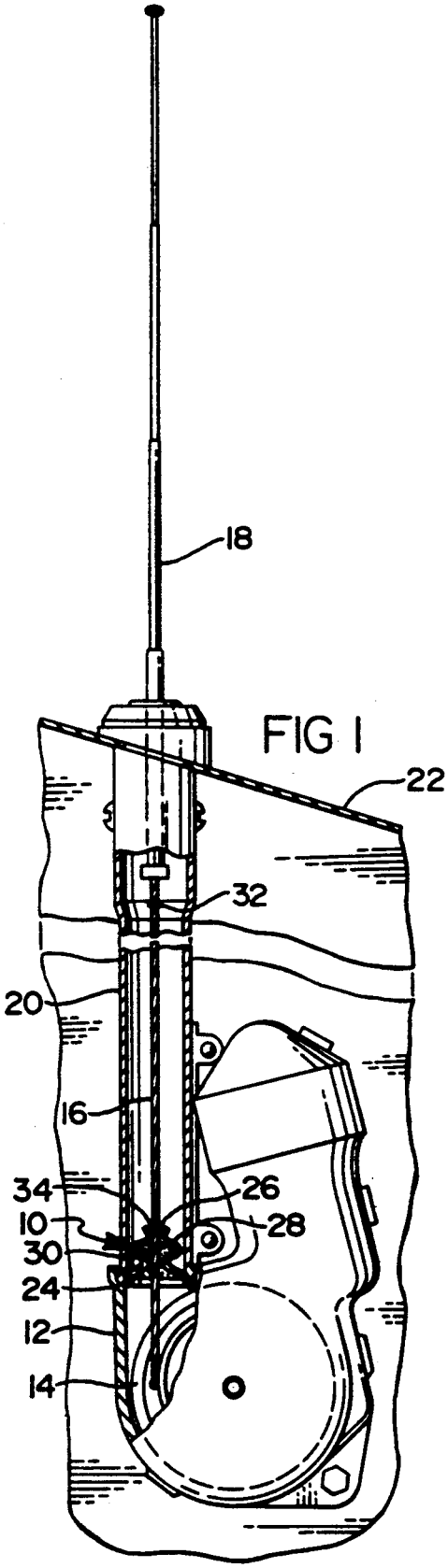
FIG. 1 shows a portion of a vehicle fender, beneath which is mounted a reel housing, with the antenna extended.

Referring first to FIG. 1, a preferred embodiment of the seal of the invention, indicated generally at 10, is incorporated in a typical power driven antenna system that includes a housing 12, reel 14 and flexible drive cable 16. A telescoping antenna 18 is driven up and down within a guide tube 20 that passes through a fender 22. Cable 16 unwinds from reel 14, pushing antenna 18 up, and rewinds, pulling it back down. Therefore, while unwinding, cable 16 is put into compression, and in tension while rewinding. Cable 16 is stiff enough to withstand the compression necessary to lift antenna 18, but its compression resistance is much more limited than its tension potential. Cable 16 is shielded within the sections of antenna 18, but is still exposed to water and dust contamination above fender 22. It is desirable to scrape such contaminants away as cable 16 is being rewound, so as to keep them out of housing 12 and off of reel 14. Seal 10 does so in a dynamic fashion that cooperates with cable 16 and accommodates the compression-tension differential of cable 16, and cooperates therewith.

Figure 2:
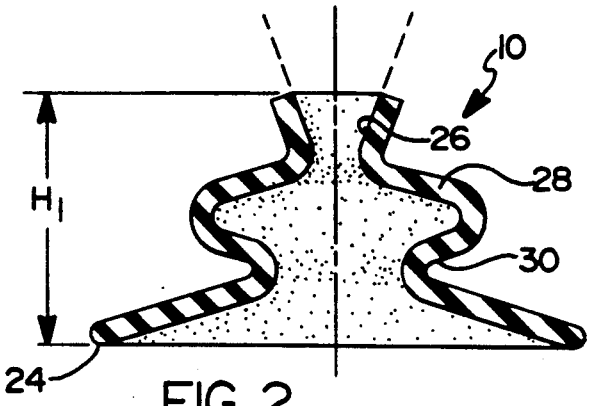
FIG. 2 is a cross section of the seal alone, in its expanded, cable passing configuration.
Figure 3:
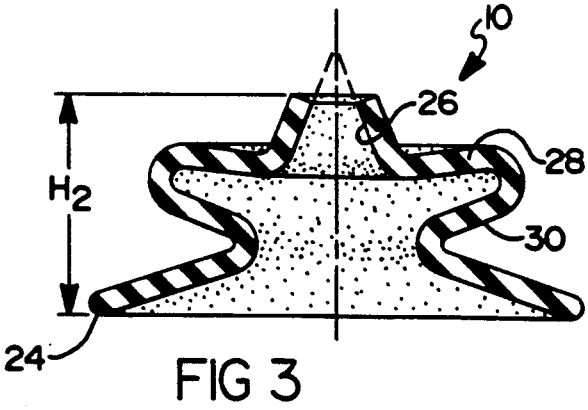
FIG. 3 is a cross section of the seal alone, in its collapsed, cable scraping configuration.

Referring next to FIGS. 2 and 3, the structural details of seal 10 are illustrated. Seal 10 is molded of rubber or other tough and resilient elastomer, and has a general bellows shape. At the bottom, a circular base 24 is sized to fit into the bottom of tube 20. At the top, is an opening in the form of a flared throat 26 which has a least diameter that is substantially equal to, slightly less than, the outer diameter of cable 16. However, the position of the least diameter shifts significantly as seal 10 operates. Intermediate base 24 and throat 26 is a body portion 28 that is generally conical, and which merges into base 24 across a live hinge 30. Since body portion 28 is resilient, conical, and unrestrained except at base 24, it can be pushed down and collapsed from one stable position to another. Specifically, the application of an axially downward force will collapse seal 10 from the FIG. 2 convex configuration, with a height $H_{1ll}$, *to the FIG. 3 concave configuration, with a height* $H_2$. The whole seal 10 bulges out partially as this occurs, and its flexing is assisted by the hinge 30, which further decouples the conical body portion 28 from the restrained base 24. Concurrently, as seal 10 collapses down, the throat 26 collapses radially inwardly, changing from a shape where it diverges relative to its dotted line center axis to a shape where it converges, FIG. 3. The smallest diameter of throat 26 also shifts from the upper to the lower edge. The process is reversed, with seal 10 rebounding again to the FIG. 2 configuration if an axially upward force is applied.

Figure 4:
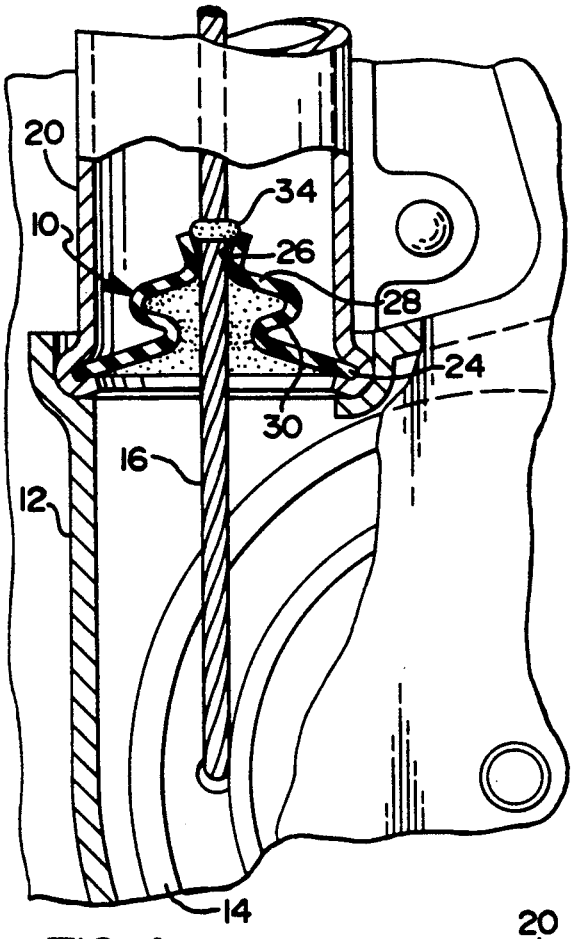
FIG. 4 is an enlarged view of the seal in place, showing it expanded.
Figure 5:
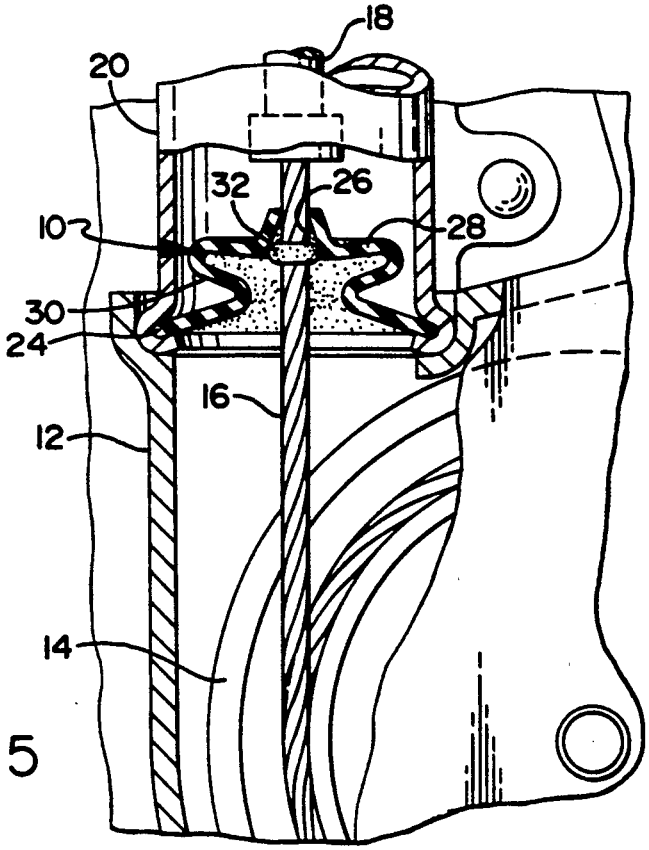
FIG. 5 is an enlarged view of the seal in place, showing it in its collapsed condition.

Referring next to FIGS. 4 and 5, the operation of seal 10 as cable 16 rewinds is illustrated. The base 24 is crimped into the bottom of guide tube 20, just ahead of where cable 16 leaves reel 14. Seal 10 then coaxially surrounds cable 16. An extra feature of the embodiment disclosed is the addition to an upper and lower button 32 and 34 on cable 16. The buttons 32 and 34 are slightly larger in diameter than the smallest diameter of throat 26, and they effectively increase the diameter of cable 16 slightly at two discrete points. These are located such that, when antenna 18 is fully extended, lower button 34 will be located just above the upper edge of throat 26, FIG. 4, and when antenna 18 is fully retracted, upper button 32 is located just below the lower edge of throat 26, FIG. 5. Buttons 32 and 34 cooperate with and assist the operation of seal 10. When antenna 18 is fully extended, cable 16 is fully unwound from reel 14, and may have picked up surface contaminants. As reel 14 begins to wind cable 16 back in to lower antenna 18, it turns counterclockwise from the perspective of FIG. 4. Lower button 34 will immediately pop through the throat 26, applying a firm downward force to seal 10, collapsing it to the FIG. 5 shape. By moving to the convergent shape of FIG. 5, throat 26 will tend to continually grab the outer surface of cable 16 and resist its sliding through. However, since cable 16 is in tension, it can easily overcome that resistance, and rewinds without hindrance. A strong scraping action is thereby applied to the outer surface of the rewinding cable 16, and any contaminants are cleaned off before cable 16 reaches the reel 14 inside housing 12. As the convergent throat 26 grabs and slips, the resilience of seal 10 and its bellows like, convoluted shape allow it to bounce and rebound in the manner of a shock absorber, and it is not damaged.

Still referring to FIGS. 4 and 5, the operation of seal 10 as cable 16 unwinds is illustrated. At the end of the rewinding cycle the upper button 32 pops through the upper edge of the still convergent seal throat 26, ending up just below the lower edge thereof, as shown in FIG. 5. Again, this does not damage seal 10, because of its resilience and bellows shape. Seal throat 26 could be potentially turned inside out by the upper button 32 down through it However, as reel 14 begins to turn clockwise and wind out to raise antenna 18, the upper button 32 immediately pops back up through throat 26, and would quickly stretch it back out to its FIG. 4 position again. Seal 10 would not create much resistance as it rebounded, and cable 16 can resist more compressive force when it is just beginning to unwind, anyway, as it is then shorter. As cable 16 continues to unwind in compression, it can slide very easily through the now divergent seal throat 26. The scraping action is not needed then, and essentially no extra compressive load is added to cable 16. A static seal, on the other hand, would apply the same force in either direction. At the end of the unwind cycle, lower button 34 pops up through the divergent throat 26, which has no effect on its shape.

Variations in the disclosed embodiment could be made. While the cable buttons 32 and 34 help assure the quick shifting of seal 10, by providing a localized increase in the diameter of cable 16, direct friction between the outer surface of cable 16 and the inner surface of the closely fitting throat 26 could provide sufficient up and down shifting force, as well. Eliminating the hinge 30 that provides the intermediate convolution between throat 26 and base 24 would provide a simpler seal shape, and still leave the conical body portion 28 that would shift up and down in a bi-stable fashion. However, the intermediate convolution adds little to the expense or complexity, and does assist the shifting action, as well as giving seal 10 more resilience and potential durability. Therefore, it will be understood that it is not intended to limit the invention to just the embodiment disclosed.

The embodiments of the invention in which an exclusive property or privilege is claimed are defined as follows:

1. For use with a power vehicle antenna of the type that has a flexible drive cable that is wound out of a housing from a reel under compression and back into the housing and onto said reel under tension, a seal surrounding said cable for keeping cable carried contaminants out of said housing, comprising, a generally circular base fixed to said housing coaxial to said cable, a generally conical, resilient body portion that is axially collapsible from a stable convex configuration to a stable concave configuration in response to an axially downward force and which rebounds in response to an axially upward force, and, a flared throat coaxial to said body portion with a least diameter slightly smaller than said drive cable that is pulled by said body portion from a divergent shape to a convergent shape and back as said body portion collapses and rebounds, whereby, an axially upward force is applied to said flared throat by cable friction as said cable unwinds under compression, thereby pulling said body portion up and maintaining said flared throat in its divergent shape and allowing said cable to unwind freely, while an axially downward force is applied to said flared throat as said cable rewinds under tension, thereby pulling said body portion down and maintaining said flared throat in its divergent shape to scrape said cable free of contaminants before it enters said housing.

2. For use with a power vehicle antenna of the type that has a flexible drive cable that is wound out of a housing from a reel under compression and back into the housing and onto said reel under tension, a seal assembly surrounding said cable for keeping cable carried contaminants out of said housing, said seal assembly comprising, a generally circular base fixed to said housing coaxial to said cable, a generally conical, resilient body portion that is axially collapsible from a stable convex configuration to a stable concave configuration in response to an axially downward force and which rebounds in response to an axially upward force, and, a flared throat coaxial to said body portion with a least diameter substantially equal to said drive cable that is pulled by said body portion from a divergent shape to a convergent shape and back as said body portion collapses and rebounds, an upper button on said drive cable having a diameter slightly larger than said cable and located thereon so as to rest just below said seal throat when said cable is fully wound up, and, a lower button on said drive cable having a diameter slightly larger than said cable and located thereon so as to rest just above said seal throat when said cable is fully unwound, whereby, as said cable begins to unwind, said upper button pops through said seal throat and creates an axially upward force, thereby pulling said body portion up and maintaining said flared throat in its divergent shape and allowing said cable to unwind freely, and as said cable begins to rewind, said lower button pops through said seal throat and creates axially downward force, thereby pulling said body portion down and maintaining said flared throat in its divergent shape to scrape said cable free of contaminants before it enters said housing.

* * * * *